US011950711B2

(12) United States Patent
Li et al.

(10) Patent No.: US 11,950,711 B2
(45) Date of Patent: Apr. 9, 2024

(54) AUTOMATIC LIFTING DISPLAY RACK

(71) Applicant: JIREE (HUA'AN) TECHNOLOGY CO., LTD., Zhangzhou (CN)

(72) Inventors: Xiaodong Li, Zhangzhou (CN); Shuangbing Li, Zhangzhou (CN); Xian Chen, Zhangzhou (CN); Dadong Su, Zhangzhou (CN)

( * ) Notice: Subject to any disclaimer, the term of this patent is extended or adjusted under 35 U.S.C. 154(b) by 0 days.

(21) Appl. No.: 18/098,707

(22) Filed: Jan. 19, 2023

(65) Prior Publication Data

US 2024/0065453 A1 Feb. 29, 2024

(30) Foreign Application Priority Data

Aug. 24, 2022 (CN) ..... 202222236653.2
Nov. 17, 2022 (CN) ..... 202223060820.9

(51) Int. Cl.
*A47F 1/06* (2006.01)
*A47F 5/16* (2006.01)

(52) U.S. Cl.
CPC . *A47F 1/06* (2013.01); *A47F 5/16* (2013.01)

(58) Field of Classification Search
CPC ..... A47F 1/06; A47F 5/16; B65G 1/07; G07F 11/14; G07F 11/20; G07F 11/22
See application file for complete search history.

(56) References Cited

U.S. PATENT DOCUMENTS 3,475,069 A * 10/1969 Olsen ..... B65G 1/07 211/59.3
3,494,503 A * 2/1970 Kingsley ..... B65G 1/07 312/306
3,659,913 A * 5/1972 Waldron ..... B65G 1/07 312/71
3,675,912 A * 7/1972 Des Jardins ..... B65G 1/07 206/817
5,178,299 A * 1/1993 Mundt ..... G07F 11/045 221/226
5,199,600 A * 4/1993 Fietsam ..... B65G 1/07 221/244
5,893,615 A * 4/1999 Hendricks ..... G07F 11/14 312/319.1
6,035,973 A * 3/2000 Neal ..... B65G 1/07 187/244
6,250,500 B1 * 6/2001 Schweiberer ..... G07F 11/22 221/244
2005/0150434 A1 * 7/2005 Wilson ..... B65D 19/02 108/55.1
2006/0145411 A1 * 7/2006 Yamamiya ..... G07F 11/16 271/11

(Continued)

*Primary Examiner* — Ko H Chan

(57) ABSTRACT

An automatic lifting display rack includes a display rack body, an elastic device, and a lifting platform. The display rack body has an accommodation space therein. The elastic device is disposed in the accommodation space. The lifting platform is above the elastic device. Corners of the lifting platform are integrally connected with a plurality of first upright posts that are parallel to side walls of the accommodation space. At least one first roller is mounted to each of the first upright posts. The first roller is configured to roll on a corresponding one of the side walls of the accommodation space. The automatic lifting display rack can improve the smoothness and stability of the lifting platform to be moved up and down.

16 Claims, 9 Drawing Sheets

(56) References Cited

U.S. PATENT DOCUMENTS

| | | | | |
|---|---|---|---|---|
| 2020/0329888 | A1* | 10/2020 | Cooper | A47F 3/06 |
| 2023/0131536 | A1* | 4/2023 | Glogowski | A47F 1/06 221/279 |

* cited by examiner

AUTOMATIC LIFTING DISPLAY RACK

BACKGROUND OF THE INVENTION

1. Field of the Invention

The present invention relates to a display rack, and more particularly to an automatic lifting display rack.

2. Description of the Prior Art

In general, a conventional display rack is equipped with an automatic lifting structure to move the bearing plate of the display rack up and down automatically. After the articles are taken away, the remaining articles ascend to the required height automatically for the next customer to pick up the articles. There is no need for the customer to stoop to pick up the articles.

As shown in FIG. 1, a large spring c is arranged between the bottom of a frame a and a bearing plate b of the conventional display rack. The bearing plate b is moved up and down automatically via the elastic force of the spring c. However, the conventional display rack has the following problems in use. The single large spring c mainly acts on the center of the lower surface of the bearing plate b. When the articles on the bearing plate b are placed unevenly, the bearing plate b is prone to tilt, resulting in instability in the lifting process. The bearing plate cannot be moved up and down smoothly.

SUMMARY OF THE INVENTION

The primary object of the present invention is to provide an automatic lifting display rack, which can improve the smoothness and stability of a lifting platform to be moved up and down.

In order to achieve the above object, the present invention adopts the following technical solutions:

An automatic lifting display rack comprises a display rack body, an elastic device, and a lifting platform. The display rack body has an accommodation space therein. The elastic device is disposed in the accommodation space. The lifting platform is driven by the elastic device to move up. Corners of the lifting platform are integrally connected with a plurality of first upright posts that are parallel to side walls of the accommodation space. At least one first roller is mounted to each of the first upright posts. The first roller is configured to roll on a corresponding one of the side walls of the accommodation space.

The first upright posts are located at corners of a lower surface of the lifting platform.

Preferably, a horizontal bar is connected between every adjacent two of the first upright posts of the lifting platform.

Preferably, both ends of the horizontal bar are connected to middle portions of the adjacent upright posts.

The accommodation space has a cuboid shape. A planar shape of the lifting platform is a rectangle. The first upright posts are disposed at the four corners of the lifting platform.

Preferably, the first upright posts each have two first rollers at a same height. The two first rollers roll on the adjacent side walls of the accommodation space.

Preferably, upper and lower ends of each of the first upright posts are provided with at least one pair of first rollers, respectively.

The elastic device includes a first spring, a holder and a second spring that are arranged sequentially in a top-down direction. An upper end of the first spring cooperates with the lower surface of the lifting platform. A lower end of the first spring cooperates with an upper surface of the holder. An upper end of the second spring cooperates with a lower surface of the holder. A lower end of the second spring is disposed at a bottom of the accommodation space.

Preferably, a periphery of the holder is integrally connected with a plurality of second upright posts that are parallel to the side walls of the accommodation space. Upper and lower ends of each of the second upright posts are equipped with second rollers. The second rollers are configured to roll on the side walls of the accommodation space.

Preferably, the second upright posts and the first upright posts are staggered in a vertical direction of the accommodation space.

Preferably, the first spring includes two first springs, and the second spring includes two second springs. The first springs and the second springs are arranged side by side on the upper and lower surfaces of the holder in the direction of a long axis of the holder, respectively.

Preferably, the elastic device further includes a bracket at the bottom of the accommodation space. The lower end of the second spring cooperates with an upper surface of the bracket. The lower surface of the lifting platform and the upper surface of the holder are respectively provided with a plurality of first corner fittings and second corner fittings for positioning the upper and lower ends of the first spring. The first corner fittings and the second corner fittings surround the upper and lower ends of the first spring, respectively. The lower surface of the holder and the upper surface of the bracket are respectively provided with a plurality of third corner fittings and fourth corner fittings for positioning the upper and lower ends of the second spring. The third corner fittings and the fourth corner fittings surround the upper and lower ends of the second spring, respectively.

Preferably, a positioning rod is disposed at the bottom of the accommodation space, and a lower surface of the bracket has a receiving groove. The positioning rod is engaged in the receiving groove.

The automatic lifting display rack further comprises a steel rope. The steel rope is disposed in the elastic device. Both ends of the steel rope are connected to the lower surface of the lifting platform and the bottom of the accommodation space, respectively.

Preferably, the automatic lifting display rack further comprises an upper connecting member on the lifting platform and a lower connecting member at the bottom of the accommodation space. The upper connecting member and the lower connecting member are made of a metal material. The upper connecting member is locked to an upper surface of the lifting platform. The upper connecting member includes a connecting ring passing through the lower surface of the lifting platform. The lower connecting member is disposed on a bottom of the display rack body. The lower connecting member has a perforation through which the steel rope passes. The upper end of the steel rope is fixedly connected to the connecting ring. The lower end of the steel rope passes through the bottom of the accommodation space and the perforation and is connected to a retaining pin. The retaining pin is insertedly connected to the lower connecting member.

The automatic lifting display rack further comprises limiting rods configured to limit the lifting platform to a predetermined height. A plurality of mounting parts are disposed on the side walls of the accommodation space and are located at a same height. An edge of the lifting platform has notches corresponding to the mounting parts. The limiting rods are locked to the mounting parts by bolts and are located above the lifting platform.

The automatic lifting display rack further comprises a bottom plate at the bottom of the display rack body. A plurality of casters are mounted to the bottom plate.

The automatic lifting display rack further comprises a bottom plate at the bottom of the display rack body. Foot members are disposed at four corners of the bottom plate.

By adopting the above technical solutions, the present invention has the following technical effects:

1. The corners of the lifting platform are formed with the first upright posts. The first roller is mounted to each of the first upright posts. Under the action of the first upright posts and the first rollers, the lifting platform is guided and restricted, so that the lifting platform keeps its own levelness when it is moved up and down, without shaking.
2. The lifting platform is in contact with the side walls of the accommodation space via the first rollers. The first rollers are configured to roll on the side walls of the accommodation space, which can reduce the frictional force for the lifting platform to move smoothly.

DETAILED DESCRIPTION OF THE PREFERRED EMBODIMENTS

Embodiments of the present invention will now be described, by way of example only, with reference to the accompanying drawings.

Figure 1:
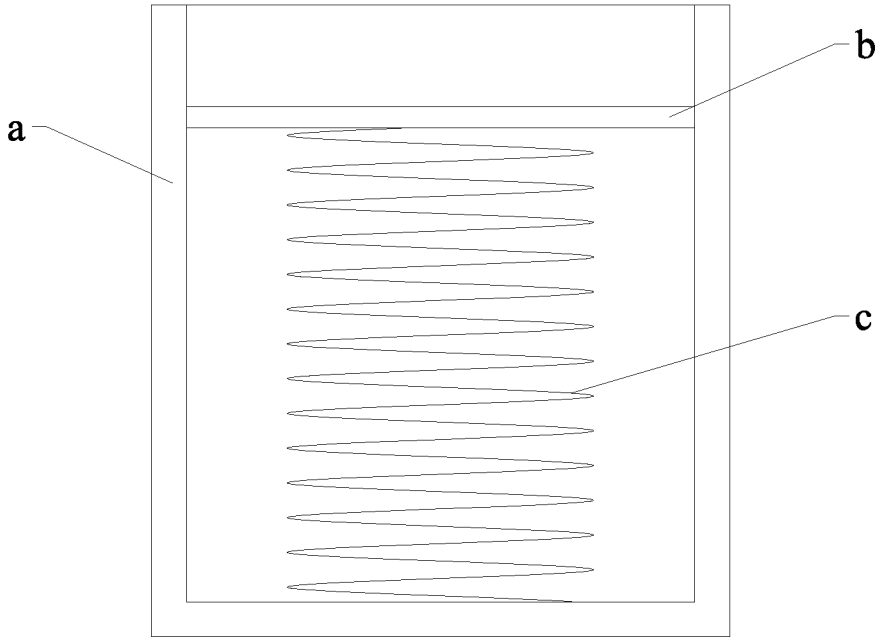
FIG. 1 (PRIOR ART)
FIG. 1 is a schematic view of a conventional display rack.
Figure 2:
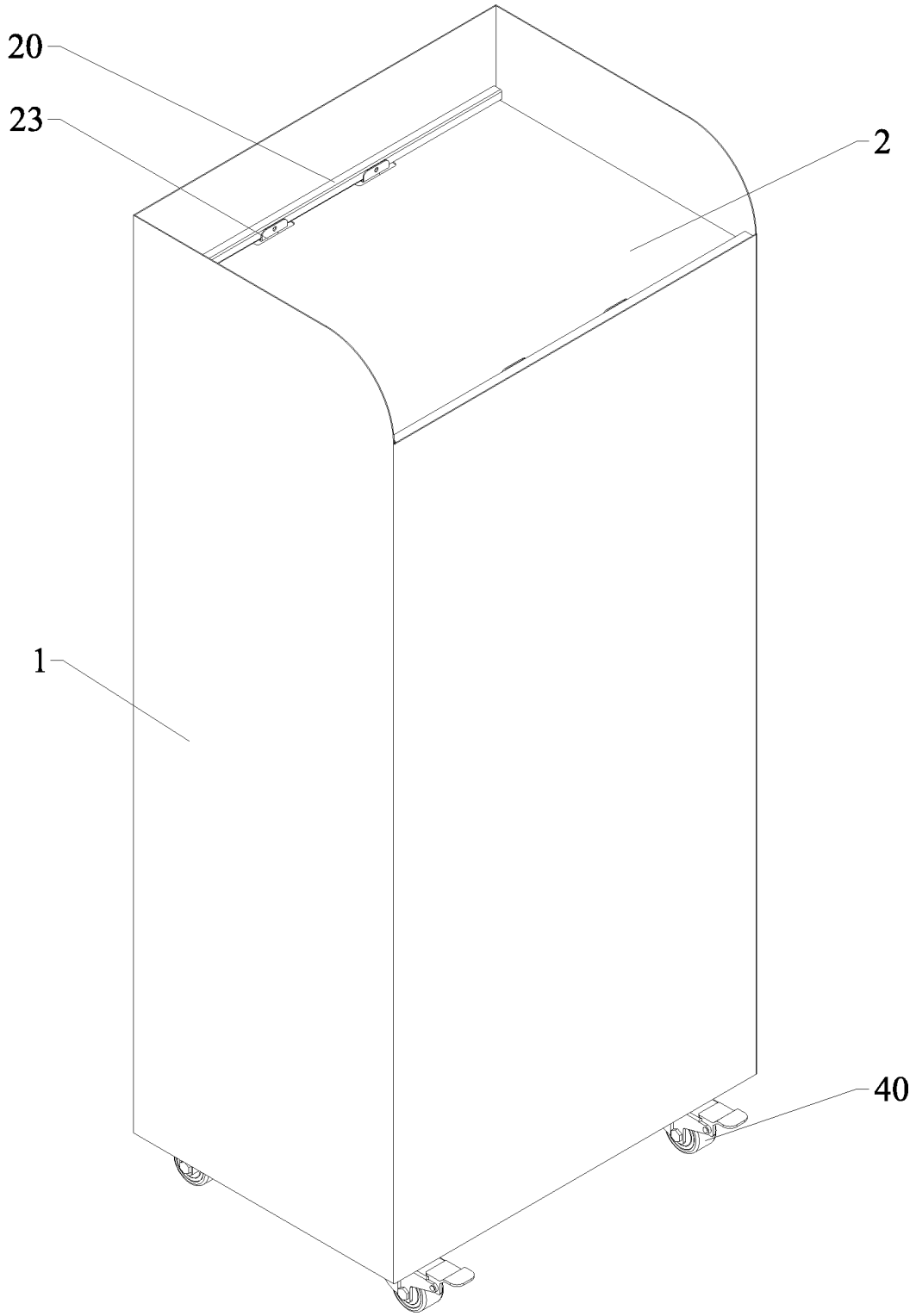
FIG. 2 is a perspective view of a first embodiment of the present invention.
Figure 3:
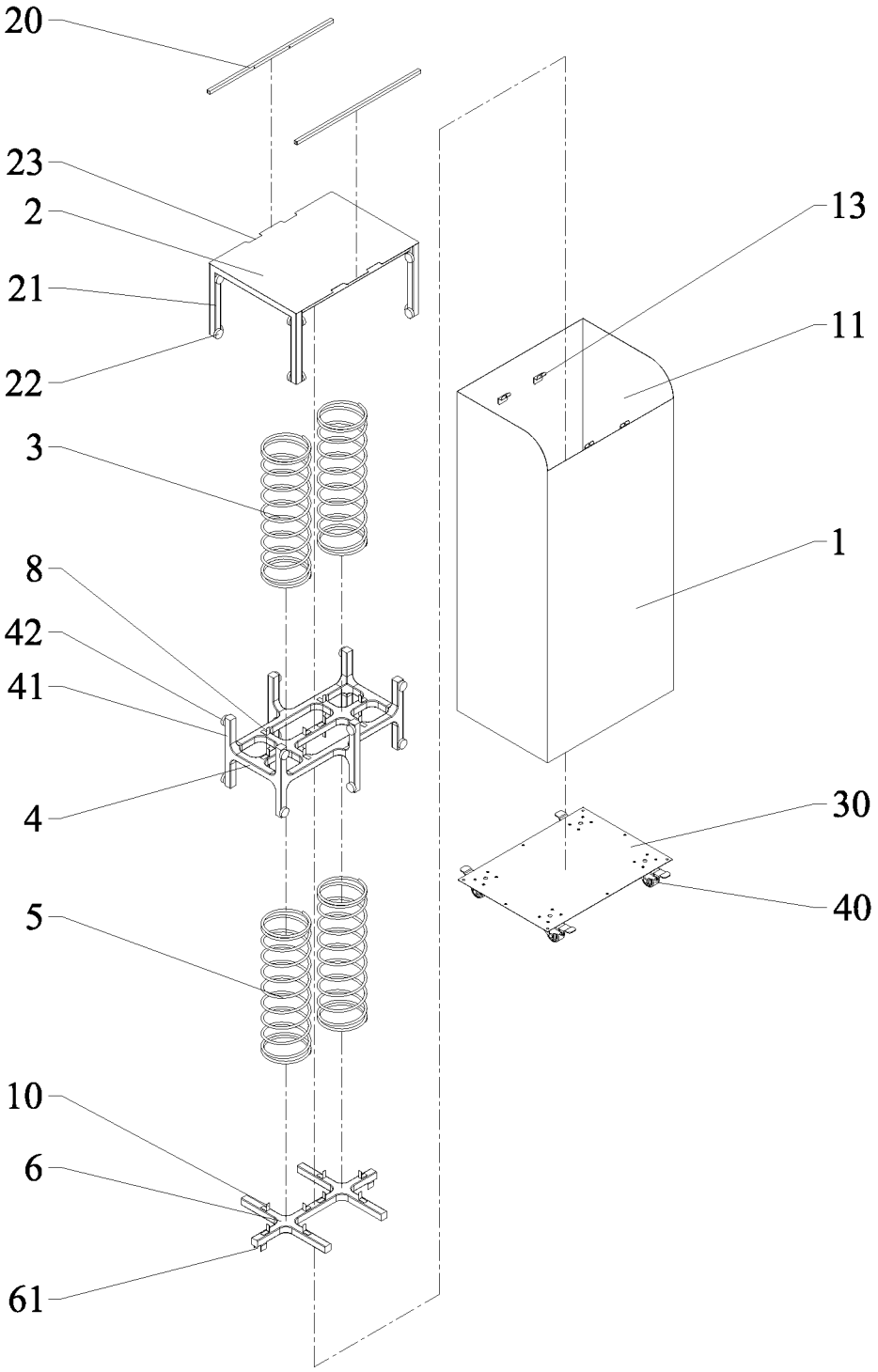
FIG. 3 is an exploded view of the first embodiment of the present invention.
Figure 4:
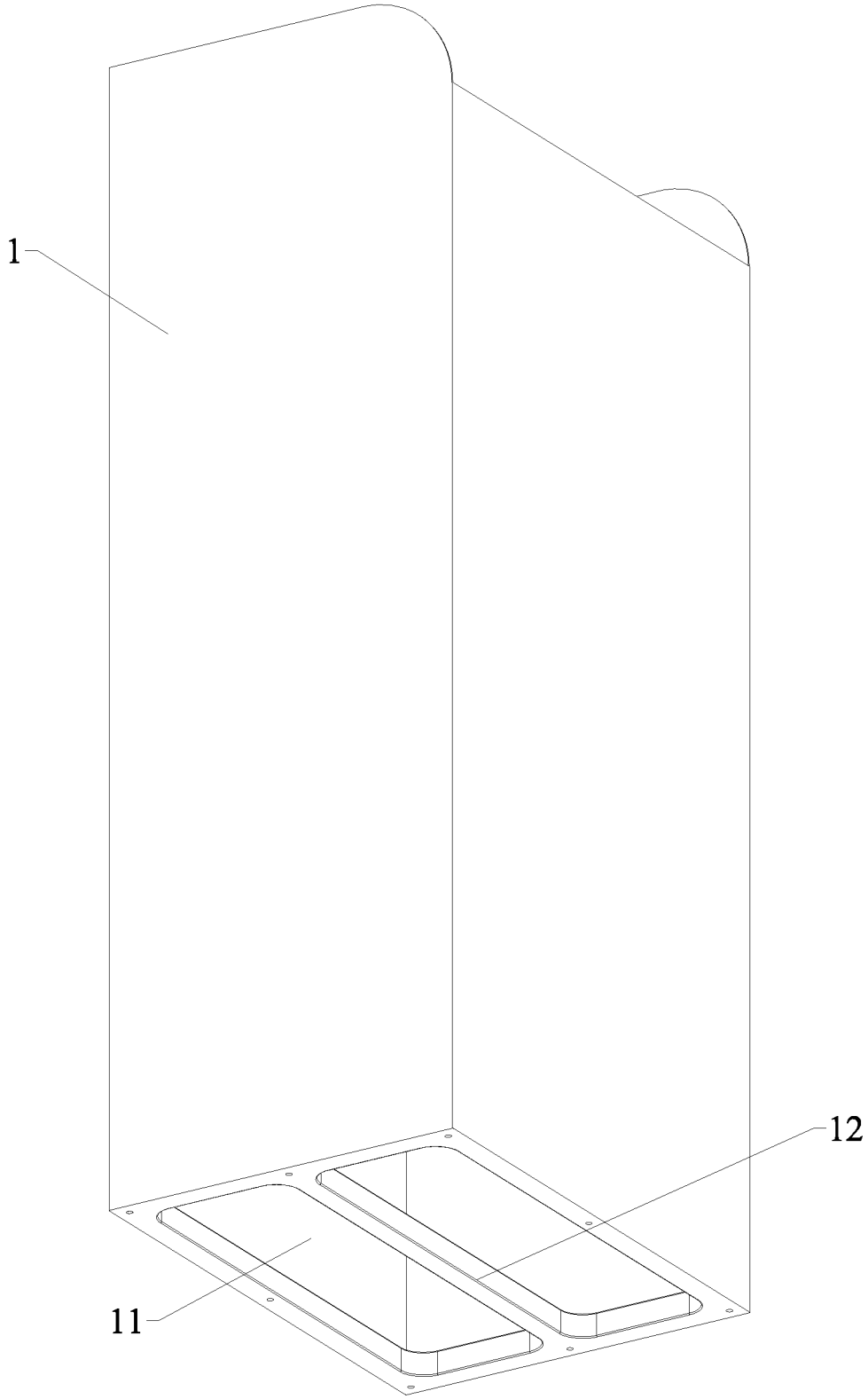
FIG. 4 is a perspective view of the display rack body according to the first embodiment of the present invention.
Figure 5:
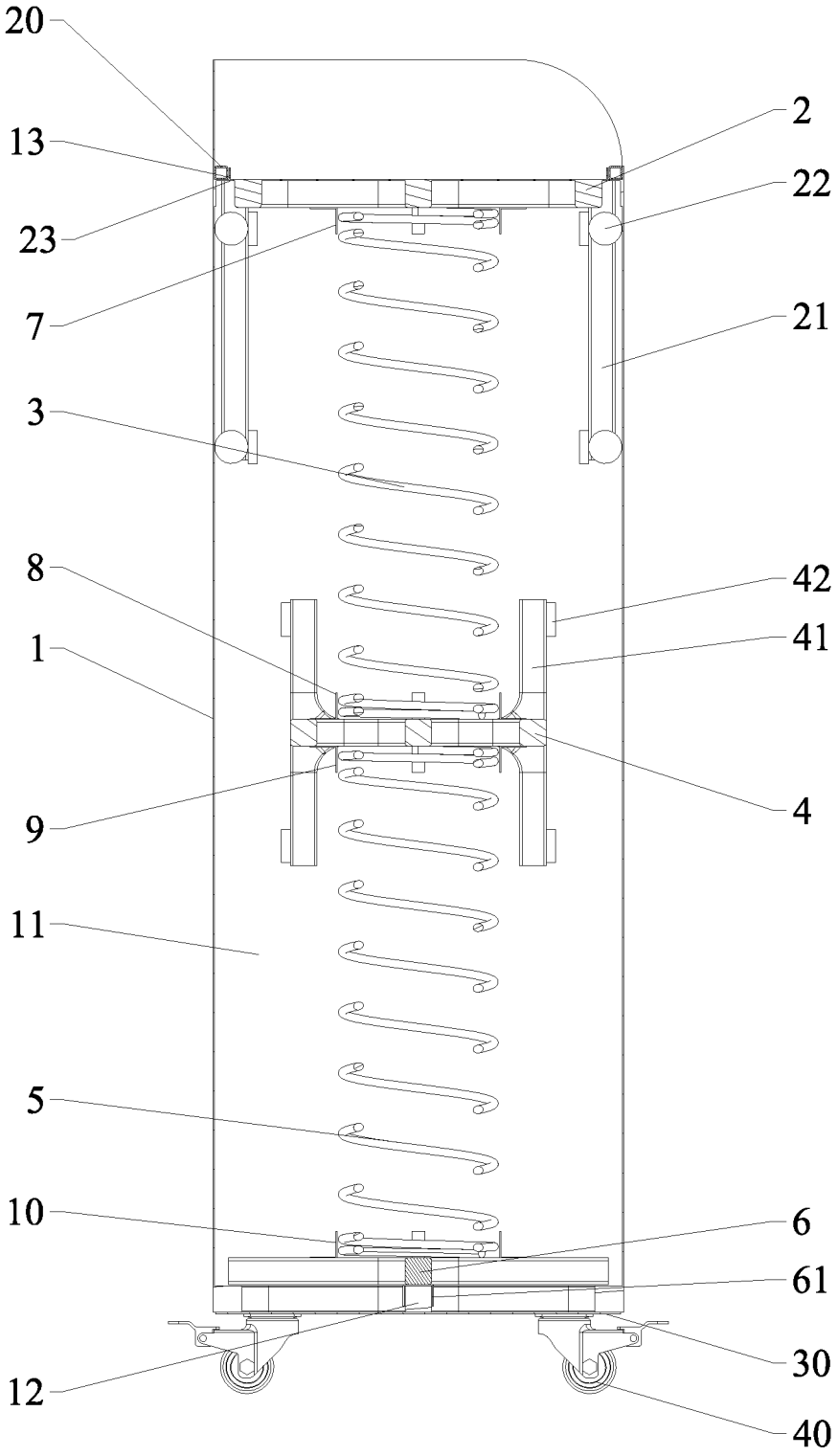
FIG. 5 is a cross-sectional view of the first embodiment of the present invention.
Figure 6:
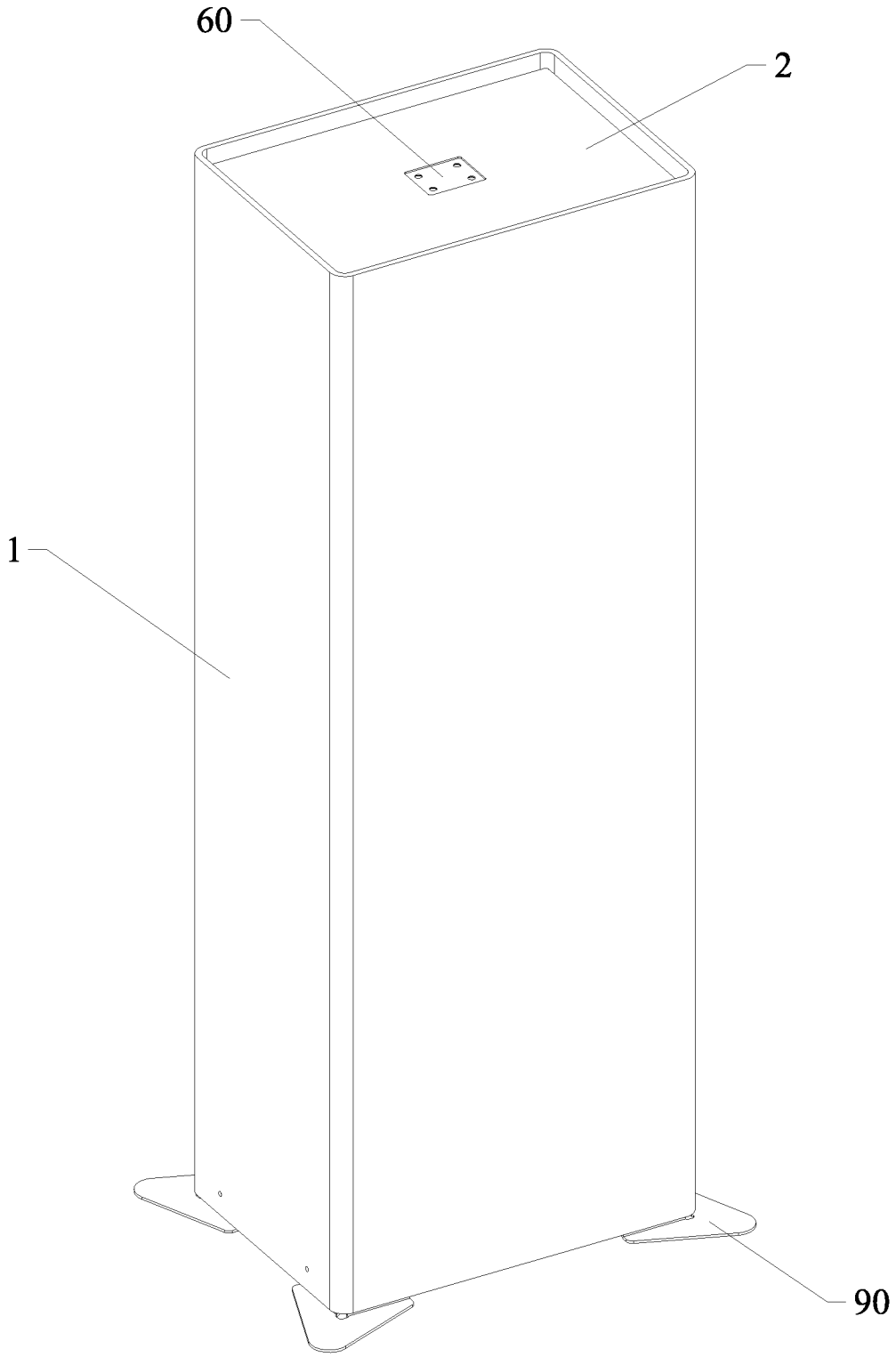
FIG. 6 is a first perspective view of a second embodiment of the present invention.
Figure 7:
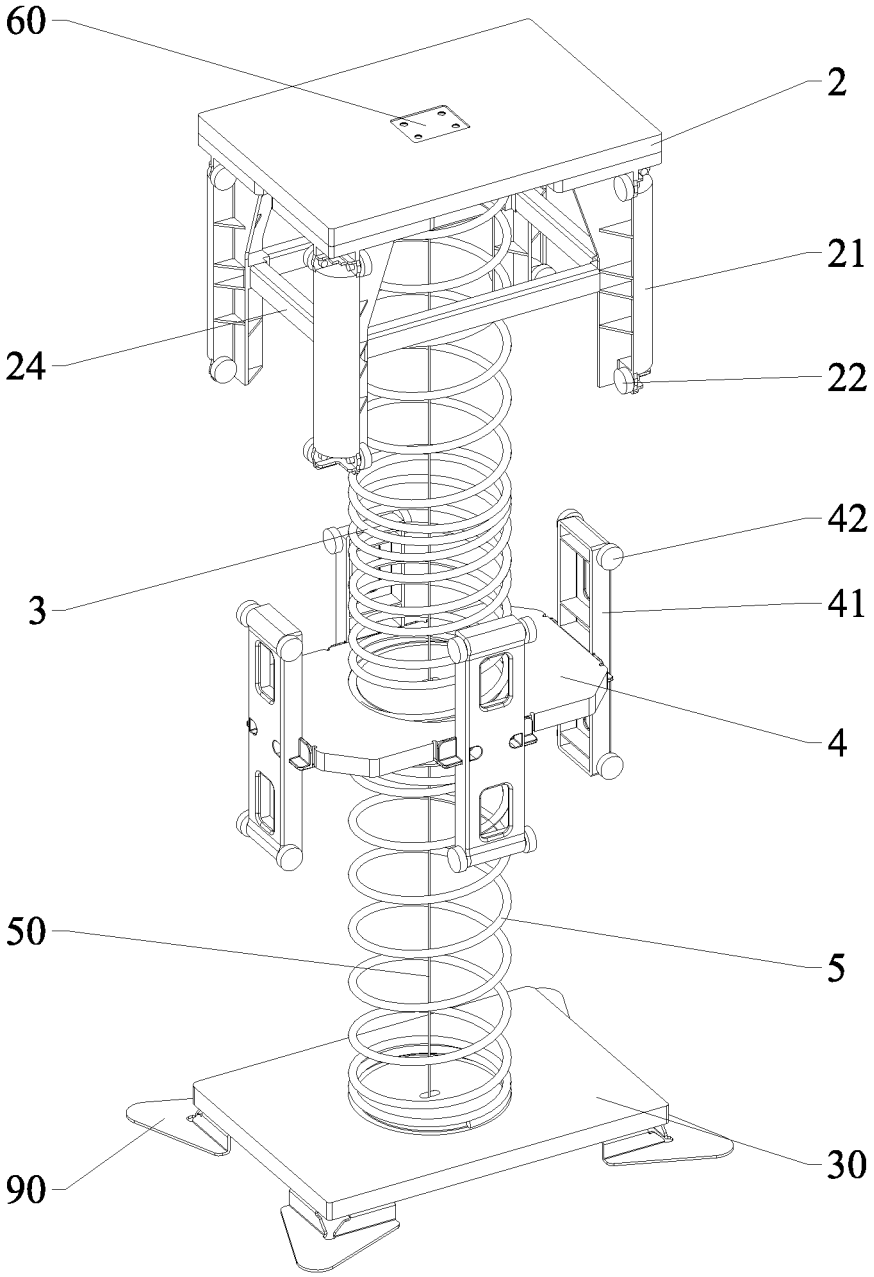
FIG. 7 is a second perspective view of the second embodiment of the present invention, without the display rack body.
Figure 8:
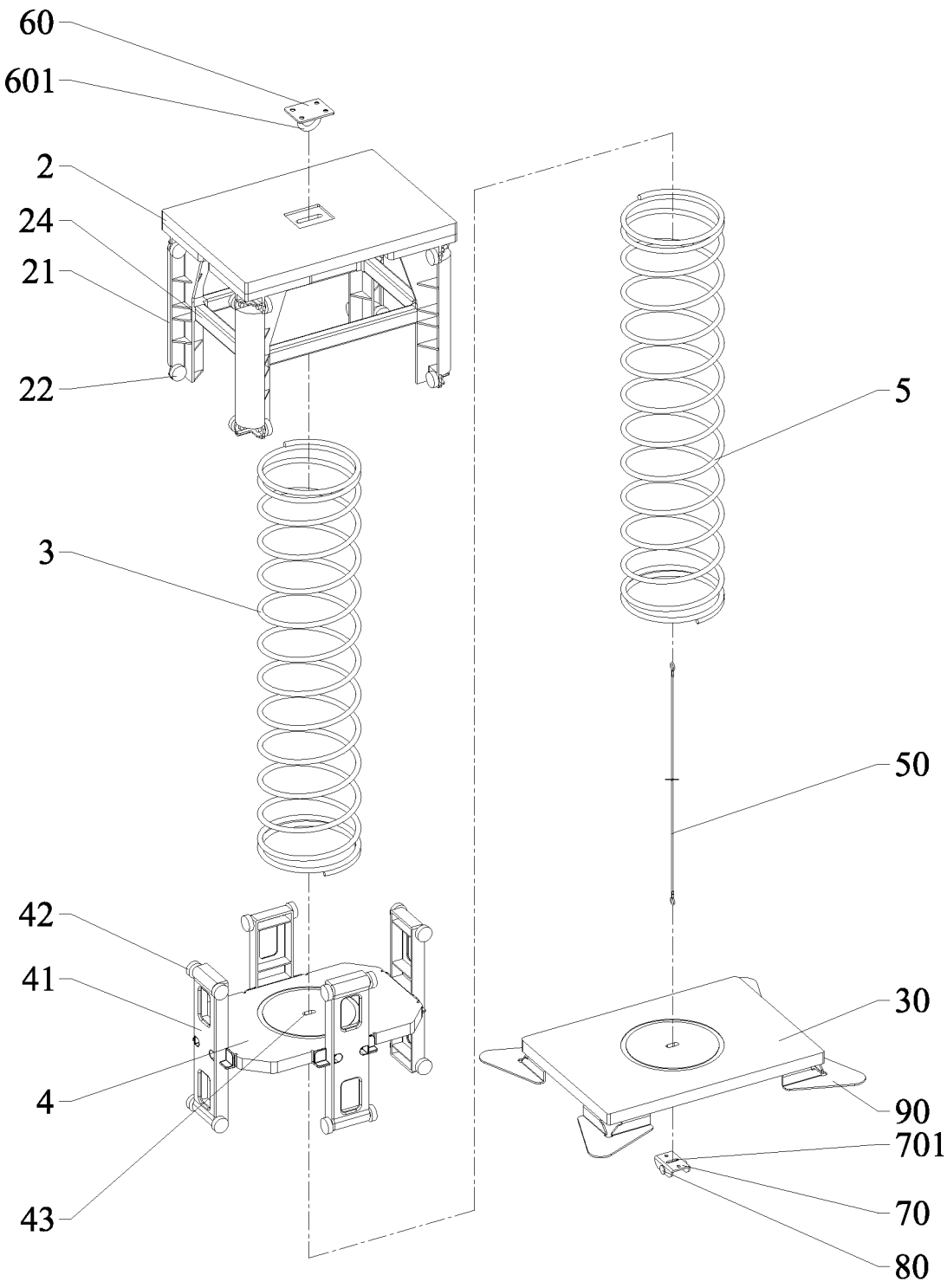
FIG. 8 is a partial exploded view of the second embodiment of the present invention, without the display rack body.
Figure 9:
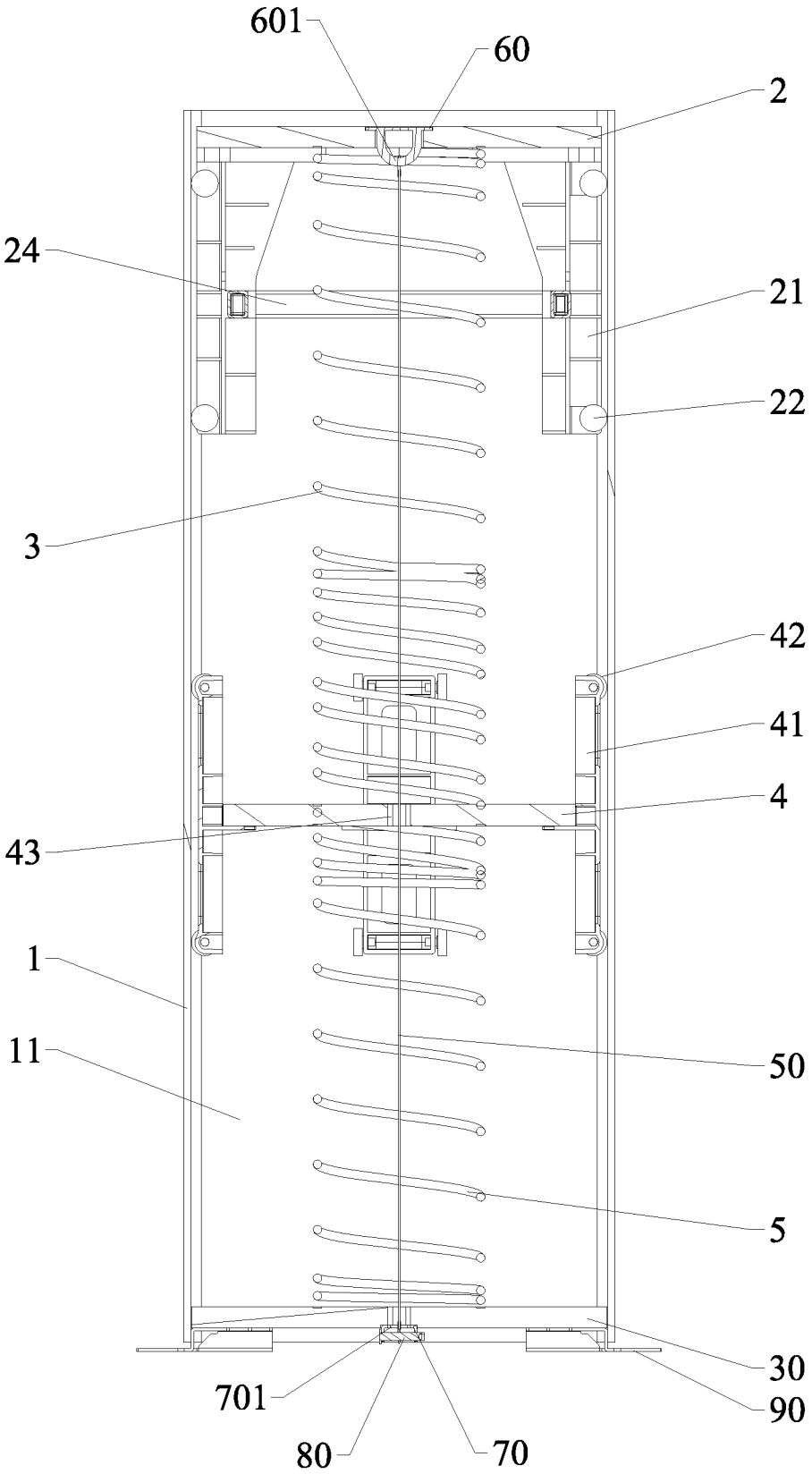
FIG. 9 is a cross-sectional view of the second embodiment of the present invention.

Referring to FIG. 2 through FIG. 9, the present invention discloses an automatic lifting display rack, comprising a display rack body 1, an elastic device and a lifting platform 2.

The display rack body has an accommodation space 11 therein.

The elastic device is disposed in the accommodation space 11.

The lifting platform 2 is driven by the elastic device to move up. The corners of the lifting platform 2 are integrally connected with a plurality of first upright posts 21 that are parallel to the side walls of the accommodation space 11. At least one first roller 22 is mounted to each of the first upright posts 21. The first roller 22 is configured to roll on a corresponding one of the side walls of the accommodation space 11.

With the above solution, in the present invention, the corners of the lifting platform 2 are formed with the first upright posts 21. The first roller 22 is mounted to each of the first upright posts 21. Under the action of the first upright posts 21 and the first rollers 22, the lifting platform 2 is guided and restricted, so that the lifting platform 2 keeps its own levelness when it is moved up and down, without shaking. Besides, the lifting platform 2 is in contact with the side walls of the accommodation space 11 via the first rollers 22. The first rollers 22 are configured to roll on the side walls of the accommodation space 11, which can reduce the frictional force for the lifting platform 2 to move smoothly.

In some embodiments of the present invention, the first upright posts 21 are located at the corners of the lower surface of the lifting platform 2. After the display rack is assembled, the first upright posts 21 are hidden in the accommodation space 11. The first upright posts 21 will not be exposed, nor will it interfere with the placement of articles on the upper surface of the lifting platform 2.

Further, a reinforcing structure may be disposed between the first upright post 21 and the lower surface of the lifting platform 2, or between every adjacent two of the first upright post 21, so as to improve the structural strength of the first upright post 21.

In some embodiments of the present invention, the first upright posts 21 are disposed at the corners of the lifting platform 2, which means that the first upright posts 21 are disposed at the four corners of the lifting platform 2. In general, the accommodation space 11 has a cuboid shape. The peripheral contour of the lifting platform 2 matches the accommodation space 11, that is, the planar shape of the lifting platform 2 is a rectangle. The first upright posts 21 are preferentially disposed at the four corners of the lifting platform 2, so that the first upright posts 21 can evenly share the pressure on the lifting platform 2 when articles are placed on the lifting platform 2. The four corners of the accommodation space 11 have a restriction effect on the first upright posts 21.

Further, when the first upright posts 21 are disposed at the four corners of the lifting platform 2, the first upright posts 21 each have two (that is, a pair of) first rollers 22 at the same height. The two first rollers 22 roll on the adjacent side walls of the accommodation space 11, respectively. In the process of lifting the lifting platform 2, the first upright post 21 is subjected to reaction forces in two directions perpendicular to each other. This can avoid the deflection of the first upright post 21 after the display rack has been used for a long time.

Preferably, the upper and lower ends of the first upright post 21 are provided with at least one pair of first rollers 22 respectively, so that the reaction force of the first rollers 22 to the first upright post 21 acts on the upper and lower ends of the first upright post 21, thereby improving the structural stability of the first upright post 21.

In some embodiments of the present invention, the elastic device may directly adopt one or multiple springs arranged side by side. The upper and lower ends of the spring are connected to the lower surface of the lifting platform 2 and the bottom of the accommodation space 11, respectively. When the preset height of the lifting platform 2 exceeds a certain value, the spring will be relatively high in height, which may cause the spring to bend in the extension and retraction process and affect its functional stability. Whether the spring will bend is affected by factors such as the material, wire diameter, and outer diameter of the spring. Accordingly, the elastic device needs to be improved. The elastic device includes a first spring 3, a holder 4 and a second spring 5 that are arranged sequentially in a top-down direction. The upper end of the first spring 3 cooperates with the lower surface of the lifting platform 2. The lower end of the first spring 3 cooperates with the upper surface of the holder 4. The upper end of the second spring 5 cooperates with the lower surface of the holder 4. The lower end of the second spring 5 is disposed at the bottom of the accommodation space 11. When the elastic device is composed of multiple springs such as the first spring 3 and the second spring 5, it still keeps sufficient elastic force. The height of a single spring becomes smaller. Thus, the spring will not bend easily in the extension and retraction process. The function of the spring is more stable.

Further, the periphery of the holder 4 is integrally connected with a plurality of second upright posts 41 that are parallel to the side walls of the accommodation space 11. The upper and lower ends of each of the second upright posts 41 are equipped with second rollers 42. The second rollers 42 are configured to roll on the side walls of the accommodation space 11. By arranging the second upright posts 41 and the second rollers 42, the holder 4 can be moved up and down in the accommodation space 11 smoothly.

The second upright posts 41 and the first upright posts 21 are staggered in the vertical direction of the accommodation space 11, so that when the first spring 3 is compressed to its limit, the first upright posts 21 and the second upright posts 41 will not collide and interfere with each other.

FIGS. 2 to 5 illustrate a first embodiment of the present invention.

In the first embodiment, two first springs 3 and two second springs 5 are provided. The first springs 3 and the second springs 5 are arranged side by side on the upper and lower surfaces of the holder 4 in the direction of the long axis of the holder 4, respectively.

In the first embodiment, six second upright posts 41 are provided. The six second upright posts 41 are located at the four corners and the middles of the two long sides of the holder 4, respectively. The second upright posts 41 located at the four corners of the holder 4 and the first upright posts 21 are staggered in the vertical direction of the accommodation space 11.

In the first embodiment, the elastic device further includes a bracket 6 at the bottom of the accommodation space 11. The lower end of the second spring 5 cooperates with the upper surface of the bracket 6. The lower surface of the lifting platform 2 and the upper surface of the holder 4 are respectively provided with a plurality of first corner fittings 7 and second corner fittings 8 for positioning the upper and lower ends of the first spring 3. The first corner fittings 7 and the second corner fittings 8 surround the upper and lower ends of the first spring 3 respectively, so as to position the upper and lower ends of the first spring 3. The lower surface of the holder 4 and the upper surface of the bracket 6 are respectively provided with a plurality of third corner fittings 9 and fourth corner fittings 10 for positioning the upper and lower ends of the second spring 5. The third corner fittings 9 and the fourth corner fittings 10 surround the upper and lower ends of the second spring 5 respectively, so as to position the upper and lower ends of the second spring 5. The first corner fittings 7, the second corner fittings 8, the third corner fittings 9 and the fourth corner fittings 10 are L-shaped metal parts. After the first springs 3 and the second springs 5 are confined by the lifting platform 2, the holder 4 and the bracket 6, the elastic device as a whole can be directly placed into the accommodation space 11 from the upper opening of the accommodation space 11. There is no need to worry that the first springs 3 and the second springs 5 will be deflected and loose. Therefore, the method to assemble the conventional lifting display rack is changed. There is no need to turn over and lift the display rack body 1 in the assembly process. The operation is simpler and the efficiency is higher.

Further, a positioning rod 12 is disposed at the bottom of the accommodation space 11. The lower surface of the bracket 6 is provided with a C-shaped member to form a receiving groove 61. The positioning rod 12 is engaged in the receiving groove 61, so that the bracket 6 is retained at the bottom of the accommodation space 11. This can prevent the elastic device from shaking left and right in the accommodation space 11.

In the first embodiment, the present invention further comprises limiting rods 20 configured to limit the lifting platform 2 to a predetermined height. A plurality of mounting parts 13 are disposed on the side walls of the accommodation space 11 and are located at the same height. The edge of the lifting platform 2 has notches 23 corresponding to the mounting parts 13. The limiting rods 20 are locked to the mounting parts 13 by bolts and are located above the lifting platform 2 for limiting the maximum height of the lifting platform 2 to be moved up. After the elastic device and the lifting platform 2 are placed into the accommodation space 11 from the upper opening of the accommodation space 11, the lifting platform 2 can be pressed downward for the lifting platform 2 to pass over the mounting parts 13 via the notches 23. After that, the limiting rods 20 are locked to the mounting parts 13. After the limiting rods 20 are locked, the lifting platform 2 is confined, and the pre-compression of the elastic device is completed, so that a recess with a certain volume is enclosed between the upper surface of the lifting platform 2 and the side walls of the accommodation space 10.

In the first embodiment, the present invention further comprises a bottom plate 30 disposed at the bottom of the display rack body 1. A plurality of casters 40 are mounted to the bottom plate 30, which facilitates the display rack to be pushed manually.

FIGS. 6 to 9 illustrate a second embodiment of the present invention.

In the second embodiment, a horizontal bar 24 is connected between every adjacent two of the first upright posts 21 of the lifting platform 2. The horizontal bar 24 is connected between every adjacent two of the first upright posts 21 in the horizontal direction, which keeps the upright posts 21 to be in a parallel state and improve their strength, so as to ensure that the lifting platform of the display rack can be moved up and down smoothly after a long period of use.

Further, both ends of the horizontal bar 24 are connected to the middle portions of the adjacent upright posts 21 to keep the distance between the adjacent upright posts 21. Under the reinforcement of all the horizontal bars 24, all the upright posts 21 of the lifting platform 2 are in parallel with one another when the platform 2 is moved up and down repeatedly.

In the second embodiment, the present invention further comprises a steel rope 50. The steel rope 50 is disposed in the elastic device. For example, the steel rope 50 is inserted through the first spring 3, the holder 4 and the second spring 5. Both ends of the steel rope 50 are connected to the lower surface of the lifting platform 2 and the bottom of the accommodation space 11, respectively. The stroke of the lifting platform 2 is limited by the steel rope 50 connected between the lower surface of the lifting platform 2 and the bottom of the accommodation space 11. Selecting steel ropes 50 of different lengths according to different use requirements can reserve sufficient accommodation space for the display rack in its initial state. That is, the steel rope 50 can realize the same function as the limiting rods 20 in the first embodiment.

Further, the second embodiment further comprises an upper connecting member 60 on the lifting platform 2 and a lower connecting member 70 at the bottom of the accommodation space 11. Both the upper connecting member 60 and the lower connecting member 70 are made of a metal material. The upper connecting member 60 is locked to the upper surface of the lifting platform 2. The upper connecting member 60 includes a connecting ring 601 passing through the lower surface of the lifting platform 2. The lower connecting member 70 is disposed on the bottom of the display rack body 1. The lower connecting member 70 has a perforation 701 through which the steel rope 50 passes. The upper end of the steel rope 50 is fixedly connected to the connecting ring 601. The lower end of the steel rope 50 passes through the bottom of the accommodation space 11 and the perforation 701 and is connected to a retaining pin 80. The retaining pin 80 is insertedly connected to the lower connecting member 70. Considering that most of the display racks are made of plastic materials, the upper connecting member 60 and the lower connecting member 70 made of a metal material can ensure the connection strength of the steel rope 50.

The holder 4 has a through hole 43 through which the steel rope 50 passes. The through hole 43 is an oval hole to provide sufficient offset space for the steel rope 50. Preferably, the direction of the long axis of the through hole 43 is the direction of the length of the holder 4.

In the second embodiment, two second upright posts 41 are connected to the middles of the two short sides of the holder 4, respectively. The second upright posts 41 and the first upright posts 21 are staggered in the vertical direction of the accommodation space 11.

In the second embodiment, the lower surface of the lifting platform 2, the bottom of the accommodation space 11 and the upper and lower surfaces of the holder 4 all have annular grooves to receive the ends of the springs, so as to ensure that the positions of the first spring 4 and the second spring 6 will not shift in the extension and retraction process.

In the second embodiment, the present invention further comprises a bottom plate 30 at the bottom of the display rack body 1. The lower end of the steel rope 50 is connected to the bottom plate 30.

Furthermore, the four corners of the bottom plate 30 are provided with foot members 90 for realizing the support and anti-skid effect on the bottom plate 30.

What is claimed is:

1. An automatic lifting display rack, comprising a display rack body, an elastic device and a lifting platform;

the display rack body having an accommodation space therein;

the elastic device being disposed in the accommodation space;

the lifting platform being driven by the elastic device to move up, corners of the lifting platform being integrally connected with a plurality of first upright posts that are parallel to side walls of the accommodation space, at least one first roller being mounted to each of the first upright posts, the first roller being configured to roll on a corresponding one of the side walls of the accommodation space;

the first upright posts are disposed at the four corners of the lifting platform;

at least one first roller includes two first rollers at a same height, and the two first rollers roll on the adjacent side walls of the accommodation space;

a same height at an upper end of each of the first upright posts is mounted with said two first rollers, and a same height at a lower end of each of the first upright posts is also mounted with said two first rollers.

2. The automatic lifting display rack as claimed in claim 1, wherein the first upright posts are located on a lower surface of the lifting platform.

3. The automatic lifting display rack as claimed in claim 2, wherein a horizontal bar is connected between every adjacent two of the first upright posts of the lifting platform.

4. The automatic lifting display rack as claimed in claim 3, wherein both ends of the horizontal bar are connected to middle portions of the adjacent upright posts.

5. The automatic lifting display rack as claimed in claim 1, wherein the accommodation space has a cuboid shape, a planar shape of the lifting platform is a rectangle.

6. The automatic lifting display rack as claimed in claim 1, wherein the elastic device includes a first spring, a holder and a second spring that are arranged sequentially in a top-down direction; an upper end of the first spring cooperates with a lower surface of the lifting platform, a lower end of the first spring cooperates with an upper surface of the holder; an upper end of the second spring cooperates with a lower surface of the holder, and a lower end of the second spring is disposed at a bottom of the accommodation space.

7. The automatic lifting display rack as claimed in claim 6, wherein a periphery of the holder is integrally connected with a plurality of second upright posts that are parallel to the side walls of the accommodation space, upper and lower ends of each of the second upright posts are equipped with second rollers, and the second rollers are configured to roll on the side walls of the accommodation space.

8. The automatic lifting display rack as claimed in claim 7, wherein the second upright posts and the first upright posts are staggered in a vertical direction of the accommodation space.

9. The automatic lifting display rack as claimed in claim 6, wherein the first spring includes two first springs, the second spring includes two second springs, the first springs and the second springs are arranged side by side on the upper and lower surfaces of the holder in the direction of a long axis of the holder, respectively.

10. The automatic lifting display rack as claimed in claim 6, wherein the elastic device further includes a bracket at the bottom of the accommodation space, the lower end of the second spring cooperates with an upper surface of the bracket; the lower surface of the lifting platform and the upper surface of the holder are respectively provided with a plurality of first corner fittings and second corner fittings for positioning the upper and lower ends of the first spring, the first corner fittings and the second corner fittings surround the upper and lower ends of the first spring, respectively; the lower surface of the holder and the upper surface of the bracket are respectively provided with a plurality of third corner fittings and fourth corner fittings for positioning the upper and lower ends of the second spring, the third corner fittings and the fourth corner fittings surround the upper and lower ends of the second spring, respectively.

11. The automatic lifting display rack as claimed in claim 10, wherein a positioning rod is disposed at the bottom of the accommodation space, a lower surface of the bracket has a receiving groove, and the positioning rod is engaged in the receiving groove.

12. The automatic lifting display rack as claimed in claim 1, further comprises a steel rope; the steel rope being disposed in the elastic device, both ends of the steel rope being connected to a lower surface of the lifting platform and a bottom of the accommodation space, respectively.

13. The automatic lifting display rack as claimed in claim 12, further comprising an upper connecting member on the lifting platform and a lower connecting member at the bottom of the accommodation space, the upper connecting member and the lower connecting member being made of a metal material; the upper connecting member being locked to an upper surface of the lifting platform, the upper connecting member including a connecting ring passing through the lower surface of the lifting platform; the lower connecting member being disposed on a bottom of the display rack body, the lower connecting member having a perforation through which the steel rope passes; the upper end of the steel rope being fixedly connected to the connecting ring, the lower end of the steel rope passing through the bottom of the accommodation space and the perforation and being connected to a retaining pin, the retaining pin being insertedly connected to the lower connecting member.

14. The automatic lifting display rack as claimed in claim 1, further comprising limiting rods configured to limit the lifting platform to a predetermined height; a plurality of mounting parts being disposed on the side walls of the accommodation space and being located at a same height, an edge of the lifting platform having notches corresponding to the mounting parts, the limiting rods being locked to the mounting parts by bolts and being located above the lifting platform.

15. The automatic lifting display rack as claimed in claim 1, further comprising a bottom plate at a bottom of the display rack body, a plurality of casters being mounted to the bottom plate.

16. The automatic lifting display rack as claimed in claim 1, further comprising a bottom plate at a bottom of the display rack body, foot members being disposed at four corners of the bottom plate.

* * * * *